US005906066A

United States Patent [19]

Felk

[11] Patent Number: 5,906,066

[45] Date of Patent: May 25, 1999

[54] AUTOMATIC PISTOL MECHANISM

[76] Inventor: Edward Karl Felk, 126 Skye Pt Rd., Coal Point 2283, Australia

[21] Appl. No.: 08/971,654

[22] Filed: Nov. 17, 1997

[51] Int. Cl.[6] ..... F41A 3/00

[52] U.S. Cl. ..... 42/69.02; 42/7

[58] Field of Search ..... 42/69.02, 7; 89/139, 89/144, 195, 196

[56] References Cited

U.S. PATENT DOCUMENTS 5,050,480 9/1991 Knight, Jr. et al. ..... 89/147

5,086,578 2/1992 Lishness et al. ..... 42/69.02

5,320,023 6/1994 Erdem ..... 89/195

5,502,914 4/1996 Moon ..... 42/69.02

*Primary Examiner*—Charles T. Jordan

*Assistant Examiner*—Denise J. Buckley

[57] ABSTRACT

An automatic pistol including a slide lock pivotally mounted through the frame inside the trigger guard; a trigger bar with an edge to engage a sear to move in a rearward direction and disengage from a striker foot; a magazine which is reduced at the base so that a variety of calibers can be fired from the same frame.

2 Claims, 1 Drawing Sheet

AUTOMATIC PISTOL MECHANISM

FIELD OF THE INVENTION

This invention relates to automatic pistols of the type which automatically eject the spent cartridge and chamber a new one after each shot.

1. Background of the Invention

It is known that automatic pistols usually require many parts to manufacture and make them function safely. They are usually complicated to handle and prone to accidental discharges if jarred when the pistol is loaded and cocked in ready to fire condition, thus requiring an external safety to prevent the pistol from discharging accidentally. The above makes the pistol hard to handle and costly to manufacture.

2. Object of this Invention

It is therefore the object of this invention to provide an improved pistol which is easy to use, requires a small number of parts to make it function, is safe to handle, can be produced at a very low cost and be able to fire a variety of calibres from the same frame.

SUMMARY OF THE INVENTION

This object is attained with this invention of a striker fired pistol which comprises a frame with a magazine receiving rear, a floating barrel with a cartridge receiving rear, and a slide with a breech-block in the rear which slides on the frame and engages over the barrel to form a cartridge chamber. The slide lock is pivotally mounted inside the upper front part of the trigger guard and through the frame of the pistol, wherein the slide lock having a ledge which hooks onto a ledge of a lug on the barrel and wherein when the slide and barrel assembly is fitted on the frame the ledge of the slide lock hooks up onto the ledge of the lug on the barrel therefore locking the two so that the slide cannot be removed from the frame unless the slide lock is depressed inside the trigger guard.

The trigger bar connected to the trigger and wherein the trigger bar has a plate and an edge which contacts a sear lug on a sear, said sear pivotally mounted at the rear of the frame and wherein the trigger bar has an upward protruding wing embodied on the plate which makes contact with the breech block's wedge for disconnecting the trigger bar's edge from the sear lug after the slide has moved backwards when firing the pistol. Embodied in the wedge is a concave recess which accommodates the upward protruding wing of the trigger bar. When the pistol is in the partially cocked condition after chambering, the striker is hooked on the sear by its foot. As the trigger bar is being moved backwards by activating the trigger, the edge of the trigger bar moves the sear backwards in an ark path as it pivots on a mounting pin. When the sear moves back far enough in the ark path it releases the striker allowing it to move forward for firing the pistol and wherein the trigger bar is stabilised on the sear's retaining pin by a slot in said trigger bar. The steel magazine, according to this invention, is designed so it can be used in a pistol frame which has been designed to fire a variety of calibres and wherein the magazine has a parallel tube and a reducing neck and wherein, in this invention the magazine reduces in size at the base of the tube to a size smaller than the upper part and wherein the larger part of the magazine is the same size as a polymer magazine used for smaller calibre cartridges, therefore the steel magazine is larger inside of the tube to accommodate a larger calibre cartridge. According to this invention the larger calibre magazine with its reduced base is made from steel as opposed to the smaller calibre magazines which are made from polymer, therefore sharing the same floor plate and able to be fired from the same frame.

According to this invention the pistol is very versatile, easy to shoot and a variety of calibres can be fired from the same frame just by changing the slide barrel combination and the magazine.

SPECIFIC DESCRIPTION

Figures 1, 2, 3, 4, 5:
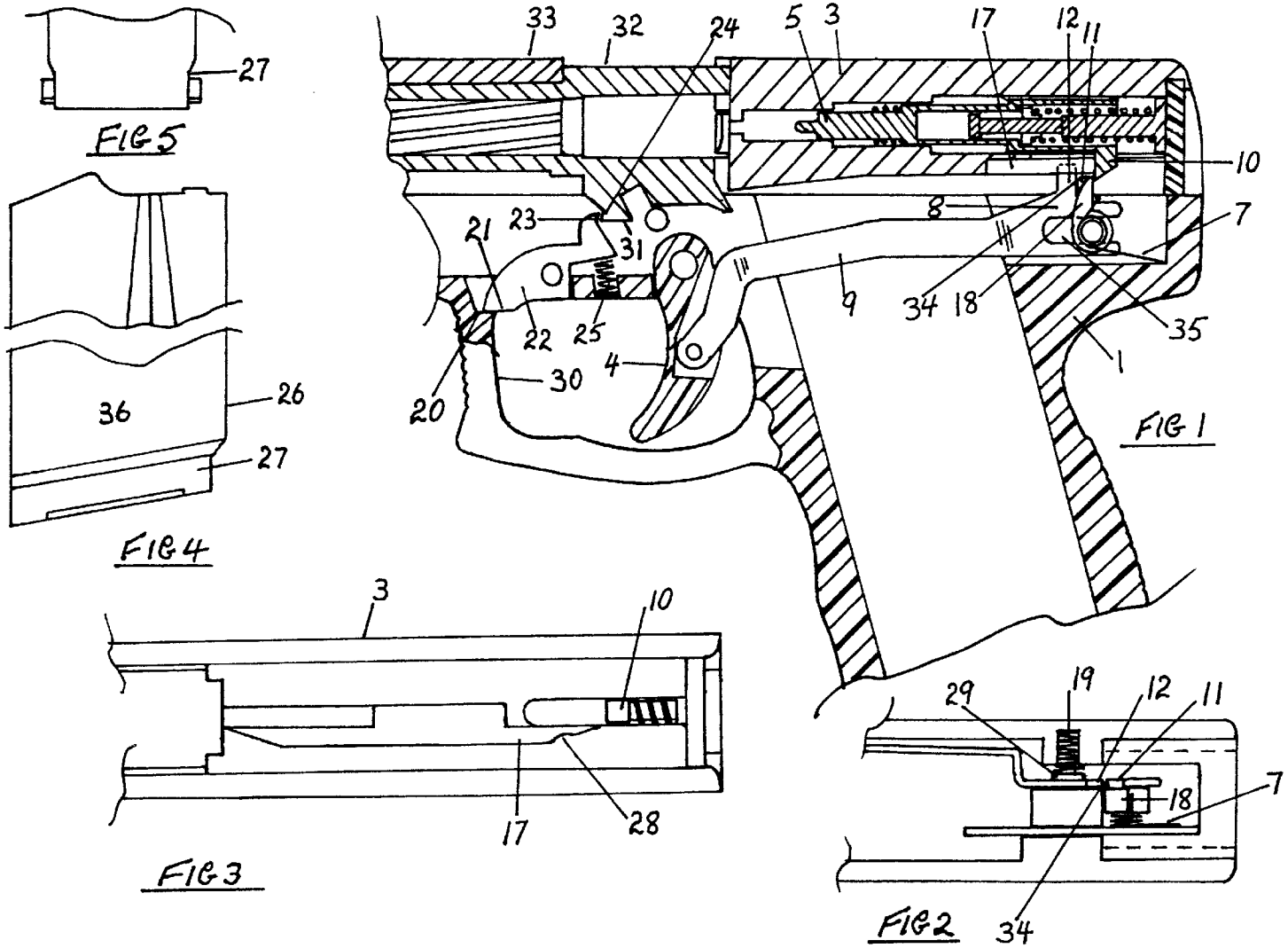
FIG. 1 shows the longitudinal section through the firing mechanism and the locking mechanism for the slide.
FIG. 2 is a top view of the rear section of the trigger bar and the sear assembly.
FIG. 3 is a view of the wedge in the breech block and the concave recess.
FIGS. 4 & 5 are the views of the magazine with the reduced base section.

FIGS. 1, 2 & 3 show the mechanism of this invention wherein the slide lock 22 pivotally mounted through the frame 1 inside the trigger guard 30 wherein the base 21 of the slide lock 22 rests on a step 20 in the trigger guard 30 and wherein a spring 25 urges the slide lock 22 upwards where it is in the locked position, when the barrel and slide assembly is fitted onto the frame 1 the lug 31 forces the slide lock 22 to tilt down, allowing the lug 31 to pass over the slide lock 22 and when lug 31 passes over the slide lock 22 the spring 25 forces the slide lock 22 up into locking position to hook the ledge 24 of the lug 31 and ledge 23 of slide lock 22 to lock the slide 33 and barrel 32 on the frame 1. To remove the barrel 32 and the slide 33 from the frame 1, the slide lock 22 is depressed inside the trigger guard 30, therefore allowing the slide 33 and barrel 32 to be removed from the frame 1.

The striker 5 has a foot 10 to engage with the sear 18 and when the trigger 4 is pulled back the trigger bar edge 34, the sear 18 and the striker foot 10 operatively engaged with the sear 18 and the striker 5 are being moved backward and wherein at the end of the reward movement the sear disengages out of operative engagement with the striker foot to allow the striker to be propelled into the cartridge chamber to fire a shot. As the slide 33 moves back with recoil, the wedge 17 pushes the trigger bar's wing 12, embodied on trigger bar plate 8, sideways out of operative engagement between edge 34 and the sear lug 11, allowing the sear 18 to return to a ready position, urged by a spring 7, ready for operative engagement with the striker foot 10 on the return of the slide 33 to chamber a cartridge and partially cock the striker 5. When the trigger 4 is returned to its forward position the trigger bar wing 12 returns into the concave recess 28 allowing the trigger bar plate 8 and the edge 34 to return into operative engagement with the sear lug 11, urged by a spring 19 and wear plug 29 mounted in the frame 1 against the side of the trigger bar plate 8. In this condition the pistol is partially cocked and ready to fire.

Embodied in the trigger bar's plate 8 is a slot 35 which stabilises the trigger bar 9 on the sear pin as it moves between the foremost and rearmost positions.

The magazine, as seen in FIGS. 4 & 5 wherein the tube of the magazine 36 is larger in size at 26 and reduces in size at the base of the magazine 27 so that a smaller floor plate can be used and a larger calibre cartridge can be fired from the same frame.

According to this invention the one piece frame (1), including all holes, cavities and slots, can be produced in one operation. There are also advantages in the assembly of the pistol, because of the low number of parts. The pistol can be assembled from components in just a few minutes at the production level.

I claim:

1. An automatic pistol comprising:

a frame with a magazine receiving grip;

a slide including a breech-block at the rear and a striker embodying a foot contained within the breach block, the striker movable between a foremost position, where it protrudes into the cartridge chamber and a rearmost position where it is fully cocked and including an intermediate position wherein it is partially cocked;

a floating barrel and the slide, movable on the frame between a foremost position, wherein the breech-block engages over the barrel to form a cartridge chamber and a rearmost position, wherein the chamber is fully open;

a trigger and a trigger bar pivotally connected, the trigger bar embodying a plate at its rearmost end, an upward extending wing with an edge and a horizontal slot in the plate, wherein the trigger and the trigger bar being movable between a foremost position, wherein the trigger and trigger bar are at rest before the actuation of the trigger and a rearmost position, wherein the trigger and the trigger bar are fully extended rearward on the actuation of the trigger, moveable in the same directions as the striker;

a triggering mechanism including the trigger and the trigger bar and the edge having abutment means with a sear lug embodied on a sear, the sear is guided along an ark path as it pivots on a retaining pin the path being a downward one towards the rear of the pistol, characterized by the striker staring in the partially cocked position after chambering, with the edge in front of the sear lug and the sear in front of the striker foot prior to the actuation of the trigger and the sear being arranged to engage the striker foot to carry the striker in a rearward direction during the movement of the sear from a rest position, the position being when the sear is pointing upwards towards the breech block, along the ark path during actuation of the trigger and to disengage from the foot to release the striker to fire a cartridge at the end of the movement when the trigger is in the rearmost position and wherein, when the slide moves rearward with recoil forces, a wedge in the breech block, which embodies a concave recess to contain the trigger bar wing while at rest, engages the wing and forces same and the trigger bar plate sideways out of operative engagement between the edge and the sear lug to allow the sear to return to the rest position, urged by a spring mounted on the sear retaining pin, ready for engagement of the striker foot and position the striker into the partially cocked position on the return of the slide to the foremost position after chambering a cartridge and wherein, when the trigger and the trigger bar are returned to the foremost position the wing is returned into the concave recess in the wedge and into operative engagement between the edge and the sear lug urged by a spring mounted in the frame against the side of the trigger bar plate, ready for the actuation of the trigger into the rearmost position to fire another shot;

a slide lock pivotally mounted through the frame inside a trigger guard wherein a base in the slide lock rests on a step in a trigger guard and a ledge of the slide lock is in a locked position urged by a spring mounted in the frame under the slide lock and wherein when the barrel and slide assembly is fitted onto the frame, a lug embodied on the barrel forces the slide lock to tilt down, allowing the lug to pass over the slide lock and hook the lug into operative engagement with a ledge in the lug and the ledge in the slide lock, therefore locking the slide and barrel on the frame, wherein to remove the slide and barrel assembly from the frame, the slide lock is depressed from inside the trigger guard to disengage the slide lock and the lug out of operative engagement, allowing the slide and barrel assembly to be removed from the frame;

a magazine comprising a tube and wherein the tube is reduced in size at the base in the area of a floor plate of the magazine, allowing for the use of a smaller floor plate which is used in smaller calibre magazines for use in a frame of a pistol which is designed to fire multiple of calibres.

2. The pistol defined in claim 1 wherein the trigger bar is stabilized by a slot in the trigger bar plate and the retaining pin, wherein the slot slides on the sear pin, as the trigger bar moves between its foremost and rearmost positions.

* * * * *